United States Patent [19]

Blake

[11] 4,301,548

[45] Nov. 24, 1981

[54] ASCOT-LIKE GARMENT

[76] Inventor: Scottie L. Blake, 201 E. 35th St., Brooklyn, N.Y. 11238

[21] Appl. No.: 117,362

[22] Filed: Jan. 31, 1980

[51] Int. Cl.[3] ..... A41B 1/04

[52] U.S. Cl. ..... 2/91

[58] Field of Search ..... 2/91, 65, 144, 155, 2/207

[56] References Cited

U.S. PATENT DOCUMENTS

| | | | |
|---|---|---|---|
| 2,117,973 | 5/1938 | Misewicz et al. | 2/91 |
| 2,809,375 | 10/1957 | Doron | 2/91 |
| 3,439,360 | 4/1969 | Grubman | 2/91 |
| 3,466,663 | 9/1969 | Mehl | 2/65 |
| 3,479,667 | 11/1969 | Mehl | 2/65 |

*Primary Examiner*—Doris L. Troutman

*Attorney, Agent, or Firm*—Anthony H. Handal

[57] ABSTRACT

A protective warming garment (10) adapted to be worn around the neck and comprising an elongated neck covering portion (12) having a width and a length longer than its width is disclosed. A relatively narrow securing portion (36) is secured at one of its ends to the length of the neck portion. A chest protecting portion (38) has a length substantially equal to the length of the other end of the securing portion (36) at one end of the protective portion (38). It is there secured to the other end of the securing portion (36) at its said one end. The protective portion (38) gradually becomes wider towards the other end of the protective portion (38). Securing means (32, 34) is secured to opposite ends of the length of neck portion (12) whereby opposite widths of the neck portion (12) may be secured to each other and the neck portion (12) may be secured around the neck of a wearer.

5 Claims, 7 Drawing Figures

ASCOT-LIKE GARMENT

TECHNICAL FIELD

The invention relates to ascots, and, in particular, to ascots made of fur and designed for providing maximum warmth to the wearer.

BACKGROUND ART

Over the years, a great number of garments and related products have been designed for keeping people warm in cold weather. Perhaps, the most practical of these garments is the conventional scarf which is generally a piece of wool or similar fabric having a width and a length much longer than its width. Certainly, this garment has seen more widespread acceptance than any other such garment, such as ascots and the like.

Nevertheless, the common scarf does suffer from a number of inadequacies. For example, when it is being worn, it easily becomes unruffled, giving the wearer a less than perfectly neat appearance. Moreover, it generally provides the wearer with a great bulk of fabric around the back of the neck. This bulk of fabric is uncomfortable with modern clothing. Moreover, the effectiveness with which the garment prevents the entry of cold air onto the neck is not adequate, due to the nature of the wool of which the scarf is made, its natural ruffles when worn, and the fact that it becomes somewhat unruffled after a period of time.

While some attempts have been made at modifying the basic scarf, for practical reasons they have not seen employment. For example, U.S. Pat. No. 2,939,150 to Rosenthal shows a scarf with a central area made of fur. While, to some extent, this does solve the problem of keeping the wearer warm while the scarf is in place, the scarf tends to become unruffled and proper alignment of the fur patch in the middle of the scarf is difficult. Moreover, nothing is done to alleviate the great bulk of fabric around the back of the neck.

Ascots solve some of the problems, such as the uncomfortable bulk of fabric around the back of the neck. However, the thin back of conventional ascots, which may be made of rayon, silk or a similar material, fails to keep the user adequately warm under cold ambient conditions.

An improved fur collar is shown in U.S. Pat. Des. No. 6,827 to Gross et al. This patent discloses a fur collar. However, the fur in this collar is serving a largely decorative function as it is diposed only on the outside of the collar. Moreover, this decorative garment does not keep the chest warm in view of the relatively small decorative chest ornament hanging from it.

DISCLOSURE OF INVENTION

In accordance with the present invention, an ascot is provided which minimizes the loss of heat around the neck without interposing an undue bulk of material around the neck. It also maintains the warmth of the chest of the wearer. It is contemplated that the ascot will be worn over a shirt and tie and under a jacket. The construction of the ascot results in a very stable garment which is not likely to become unruffled.

The same is accomplished by providing a collar portion which includes fur which extends around the inside of the collar portion and a chest protector portion which is initially narrow near the collar where the body is most protected by the shirt collar and tie, and the collar of the jacket under which the ascot is worn, gradually widening as the heat protection of the collars becomes less effective and finally narrow relatively abruptly at points below the jacket collar. It thus, has a maximum of protective cover around the exposed neck of the wearer, a relatively small degree of protection in the area of the chest just underneath the neck (where the wearer is likely to have a tie or other warming garment) extends to a maximum at a point where the lapels of the jacket provide relatively little protection from the cold and then tapers to a point at its end where the jacket is completely closed.

BRIEF DESCRIPTION OF THE DRAWINGS

Several ways of carrying out the invention are described in detail below with reference to the drawings which illustrate only one specific embodiment of the invention in which.

DETAILED DESCRIPTION OF THE PREFERRED EMBODIMENT

Figure 5:
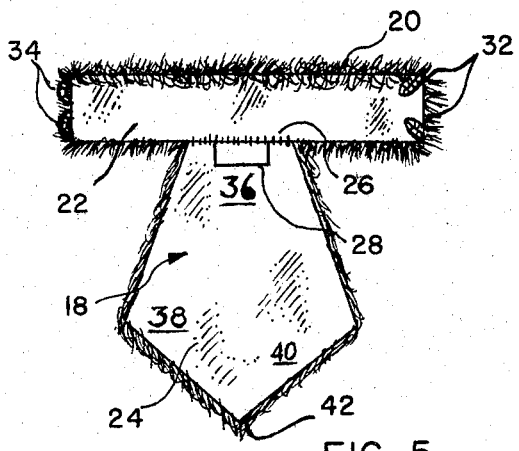
FIG. 5 is a rear elevational view of the ascot illustrated in FIG. 2.
Figure 2:
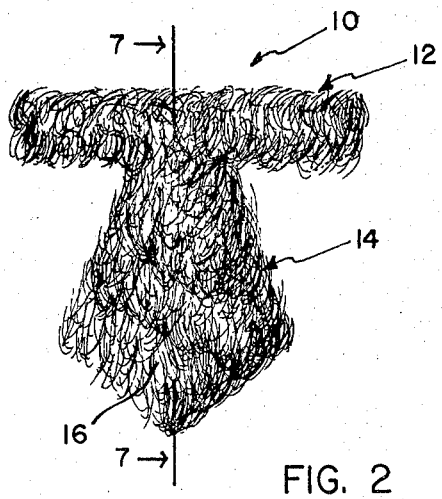
FIG. 2 is a plan view of the inventive ascot.

Referring to FIGS. 1–7, the inventive ascot 10 is illustrated. As shown most clearly in FIG. 2, the ascot 10 comprises a neck portion 12 and chest portion 14. Ascot 10 includes a front side 16 made of fur and a back side 18 (FIG. 5) made of satin or other similar material. Moreover, a portion 20 (FIG. 7) of fur extends from the front side 16 to the rear side 18 around the top of neck portion 12. This fur may be mink, rabbit, synthetic fur, or the like.

While rear side 18 may be made of a single piece of fabric, it may also be made as illustrated from two pieces of fabric 22 and 24 (FIG. 5), which are sewn together along a seam 26. This allows the simplified sewing of a label 28 into the garment.

Figure 7:
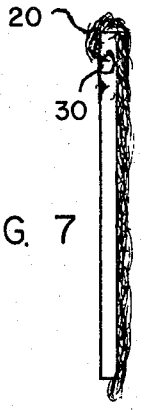
FIG. 7 is a cross-sectional view of the inventive ascot illustrated in FIGS. 1–6 along lines 7—7 of FIG. 2.
Figure 4:
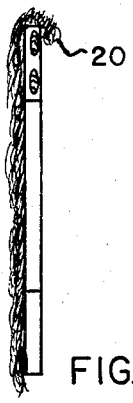
FIG. 4 is a right side elevational view of the ascot illustrated in FIG. 2.
Figure 6:
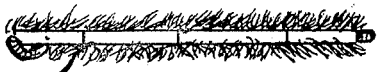
FIG. 6 is a bottom plan view of the inventive ascot.
Figure 3:
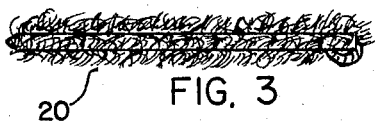
FIG. 3 is a top plan view of the inventive ascot illustrated in FIG. 2.
Figure 1:
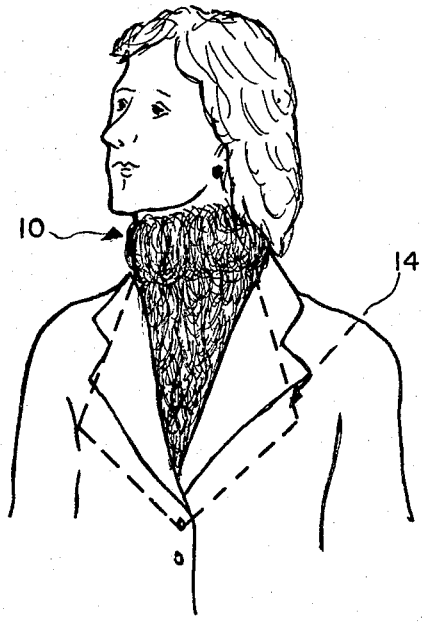
FIG. 1 is a perspective view of the inventive ascot in use.

As shown most clearly in FIGS. 3, 6 and 7, portion 20 of the fur, adjacent the upper part of neck portion 12 extends from the front of the ascot to the rear of the ascot. Referring in particular to FIG. 7, the satin fabric is joined to the fur on the rear of the ascot at a seam 30. Likewise, other seams join the fur to the satin along the perimeter of the ascot.

Referring to FIG. 5, the inventive ascot is secured around the neck by the engagement of a pair of hooks 32 with a pair of loops 34. The hooks are inwardly directed toward each other as illustrated in FIG. 5 to prevent their being unhooked accidentally. Thread is wound around the metal of which the hooks and eyes are made of, thus, making their appearance congruent with the rest of the ascot.

When it is desired to use the inventive ascot, the neck portion 12 is secured around the neck of the wearer with the chest portion 14 over the chest of the wearer. Hooks 32 are engaged with loops 34 and, usually, a jacket or coat is worn over the ascot. Typically, the wearer would wear a shirt or tie underneath the ascot. Portion 20 of the fur makes direct contact with the skin of the wearer preventing the entry of cold air underneath the ascot and onto the neck of the wearer. Because the fur is a much better insulator and thermal shield than conventional ascot material, such as silk or rayon or the wool of a scarf, it acts to keep the neck of the wearer warm.

Just below the neck of the wearer the shirt and tie provide a great deal of warmth. Therefore the width of the area 36 adjacent the neck is relatively narrow. However, as the chest portion 14 of the ascot extends away from the warmth of the lower neck area, it becomes wider, thus compensating for the loss of insulative material. Finally, in area 38 just above where the jacket collar disappears and the sides of the jacket join, the ascot chest portion is at its widest, providing a maximum of warmth where the warmth of the area below the neck has left off and the warmth of the area adjacent where the sides are joined by buttons has not begun to have its effect. This provides the needed warmth. Finally, in the area 40 below area 38, the width of the chest portion 14 tapers to a point 42, thus providing a good seal around the perimeter of the collar. This relationship is shown most clearly in FIG. 1 where the chest portion 14 of the collar is illustrated in phantom lines.

While an illustrative embodiment of the invention has been described, it is, of course, understood that various modifications of the disclosed ascot will be obvious to those of ordinary skill in the art. Such modifications are within the spirit and scope of the invention which is limited and defined only by the appended claims.

I claim:

1. A protective warming garment adapted to be worn around the neck, comprising:

(a) an elongated neck covering portion having first and second lengthwise edges and two widthwise edges, said lengthwise edges being longer than the widthwise edges;

(b) a relatively narrow securing portion secured integrally at one of its ends to the first lengthwise edge of said neck portion;

(c) a chest protecting portion, having a length substantially equal to the length of the other end of said securing portion at one end of said protective portion, integrally secured to said other end of said securing portion at said one end of said protective portion and gradually becoming wider towards the other end of said protective portion; and (d) securing means secured at opposite widthwise edges of said neck portion whereby opposite widthwise edges of said neck portion may be secured to each other and said neck portion may be secured around the neck of the wearer, said neck portion, securing portion and chest portion each having a front side and a back side and having a fur-like material disposed on their respective front side.

2. A protective garment as in claim 1 further comprising a tapered bottom portion secured at one end to the other end of said protective portion.

3. A protective garment having a front side and a back side adapted to be worn around the neck, comprising:

(a) an elongated neck covering portion having first and second lengthwise edges and two widthwise edges, said lengthwise edges being longer than the widthwise edges;

(b) a relatively narrow securing portion secured integrally at one of its ends to said first lengthwise edge of said neck portion;

(c) a chest protecting portion, having a length substantially equal to the length of the other end of said securing portion at one end of said protective portion, integrally secured to said other end of said securing portion at said one end of said protective portion and gradually becoming wider towards the other end of said protective portion; and (d) securing means secured at opposite ends of the length of said neck portion whereby said neck portion may be secured around the neck of the wearer; and wherein the front side of the garment is covered with an insulative decorative fur-like material and the back side is substantially covered with a liner of material, said insulative decorative fur-like material extending from the front of the garment around the second lengthwise edge of the neck portion opposite the lengthwise edge to which said securing portion is secured and over a portion of the back side of said neck portion in the area adjacent the length of said second lengthwise edge.

4. A garment as in claim 3 wherein said decorative material is fur.

5. A protective garment as in claim 3 wherein said securing means comprises mating hook and eye connectors, secured to opposite widthwise edges of said neck portion.

* * * * *